US006834570B2

(12) United States Patent
Risolio

(10) Patent No.: US 6,834,570 B2
(45) Date of Patent: Dec. 28, 2004

(54) FINGER WRENCH

(76) Inventor: Larry Joseph Risolio, 3700 S. Old 3C Hwy., Galena, OH (US) 43021

( * ) Notice: Subject to any disclaimer, the term of this patent is extended or adjusted under 35 U.S.C. 154(b) by 0 days.

(21) Appl. No.: 10/248,534

(22) Filed: Jan. 27, 2003

(65) Prior Publication Data

US 2004/0144216 A1 Jul. 29, 2004

(51) Int. Cl.[7] ..... B25G 1/00
(52) U.S. Cl. ..... 81/177.3; 81/125; 81/487
(58) Field of Search ..... 81/177.3, 125, 81/487, 13, 436, 121.1, 180.1

(56) References Cited

U.S. PATENT DOCUMENTS 1,286,610 A * 12/1918 Harriman ..... 224/217
2,543,283 A * 2/1951 Louis ..... 81/177.3
2,585,641 A * 2/1952 Faso ..... 81/177.3
2,735,321 A * 2/1956 Browne et al. ..... 81/177.3
3,005,367 A * 10/1961 Vose ..... 81/125
3,731,722 A * 5/1973 Carr ..... 81/125
3,834,253 A * 9/1974 Carr ..... 81/125
4,979,355 A * 12/1990 Ulevich ..... 81/125
5,193,418 A * 3/1993 Behrenfeld ..... 81/487
5,323,673 A * 6/1994 Martinez et al. ..... 81/125

* cited by examiner

*Primary Examiner*—Hadi Shakeri
(74) *Attorney, Agent, or Firm*—Jeffrey Furr

(57) ABSTRACT

A finger wrench that can be used to reach hard to reach locations. The wrench consists of a base with a retainer band. Said base having a nut holder fitting nuts of set sizes. Said nut holder having a nut retaining means such as a nub to hold the nut in place. The band attaches to the base and around the finger or a shaft.

4 Claims, 11 Drawing Sheets

FINGER WRENCH

BACKGROUND OF INVENTION

This invention relates generally to wrench type tools and more particularly those that can be used by a finger or shaft.

1. Background

Anyone who has ever used a wrench can understand the frustration of trying to loosen and remove a bolt or nut that is in a difficult to reach location, particularly if it is an enclosed and out of sight location. These are locations such as behind on a starter, alternator, stereos, heater core, heater ducts, power supplies, refrigerator units and shocks.

Sometimes even using a long lever arm to turn the wrench is not enough. Very often the bolt or nut is located in a location where attempting to start or loosen it makes the task more difficult, even with other types of gripping tools.

Wrenches having a head with a square or rectangular ratcheting shaft are well known and are commonly used in various home, shop and office environments. Shafts for such wrenches are typically available in various sizes of the English and metric measurement systems.

Interchangeable sockets can be mounted to the shaft for loosening or tightening bolts and other threaded fasteners. The sockets are often designed in sets so that multiple sockets have the same sized square shaft opening with hexagonal openings for receiving bolts heads and nuts that vary in size, such as in increments of one-sixteenth of an inch.

2. Description of Prior Art

There are adjustable sockets. Typical of these is U.S. Pat. No. 1,471,451 issued to Alfred A. Crimp on Oct. 23, 1923. Another patent was issued to George J. C. Lammers et al. on Feb. 22, 1927 as U.S. Pat. No. 1,618,715. Yet another U.S. Pat. No. 1,688,819 was issued to John Leck on Oct. 23, 1928 and still yet another was issued to John Greiner on Feb. 7, 1933 as U.S. Pat. No. 1,896,949.

Another patent was issued to Andrew Pearson on Apr. 16, 1935 as U.S. Pat. No. 1,997,948. Yet another U.S. Pat. No. 2,711,112 was issued to Adrein E. Durand on Jun. 21, 1955. Another was issued to Jesse P. Rogers on Apr. 7, 1964 as U.S. Pat. No. 3,127,797 and still another was issued on Apr. 7, 1964 to Michael J. Gol as U.S. Pat. No. 3,127,798. A patent was issued on Jan. 17, 1967 to Ben H. Lynn as U.S. Pat. No. 3,298,261 and on Jul. 16, 1985 U.S. Pat. No. 4,528,875 was issued to Andrew C. S. Hurst et al. Another patent was issued to William S. Mathers on Nov. 17, 1992 as U.S. Pat. No. 5,163,344. Yet another U.S. Pat. No. 5,829,328 was issued to Shyong-Chwan Chen on Nov. 3, 1998.

While these wrench devices may be suitable for the purposes for which they were designed, they would not be as suitable for the purposes of the present invention, as hereinafter described.

In particular, no prior art wrenches can be used in tight locations using a single finger or long shaft holding the nut or bolt head to be wrenched.

SUMMARY OF INVENTION

The present invention relates to a finger wrench that can be used to reach hard to reach locations.

It is the object of the present invention to provide a wrench that allows a user to reach hard to reach locations.

It is an addition object of the present invention to provide a wrench that allows a user for use in locations where you can not see where all a user can do is touch and feel the location with a finger. It is another object of the present invention to provide a wrench that holds the nut while it is being moved to its proper location.

Is another object of the present invention to provide a quick start for nuts. The wrench consists of a base with a retainer band, with said base containing a nutholder the fits a set set of sizes, said wrench has a nut retaining means, such as a nub, to hold the nut in place. The band attaches to the base and around the finger or a shaft.

BRIEF DESCRIPTION OF DRAWINGS

Without restricting the full scope of this invention, the preferred form of this invention is illustrated in the following drawings.

DETAILED DESCRIPTION

Figure 1:
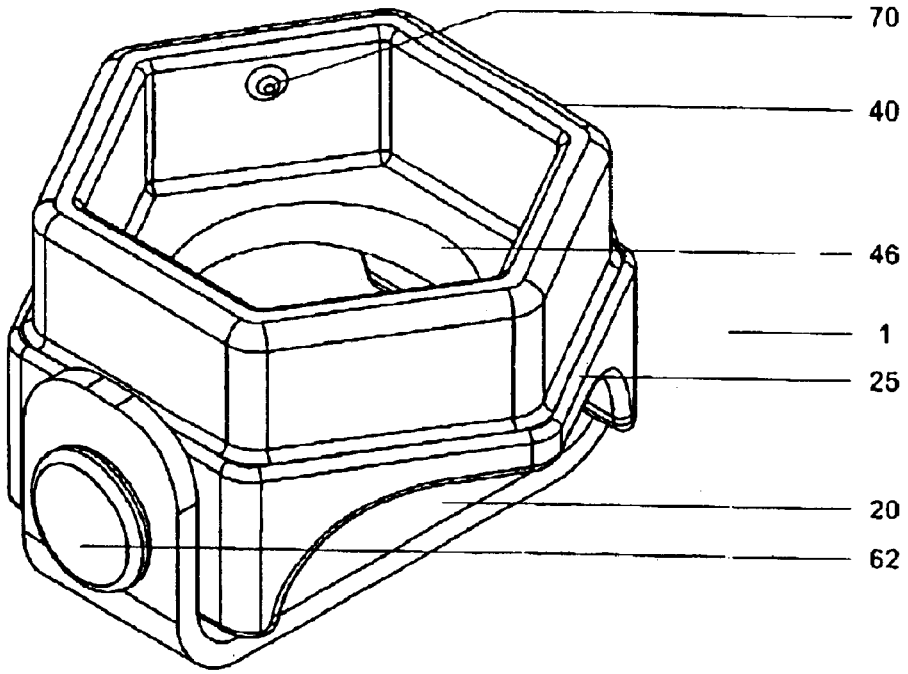
FIG. 1 shows the device.
Figure 2:
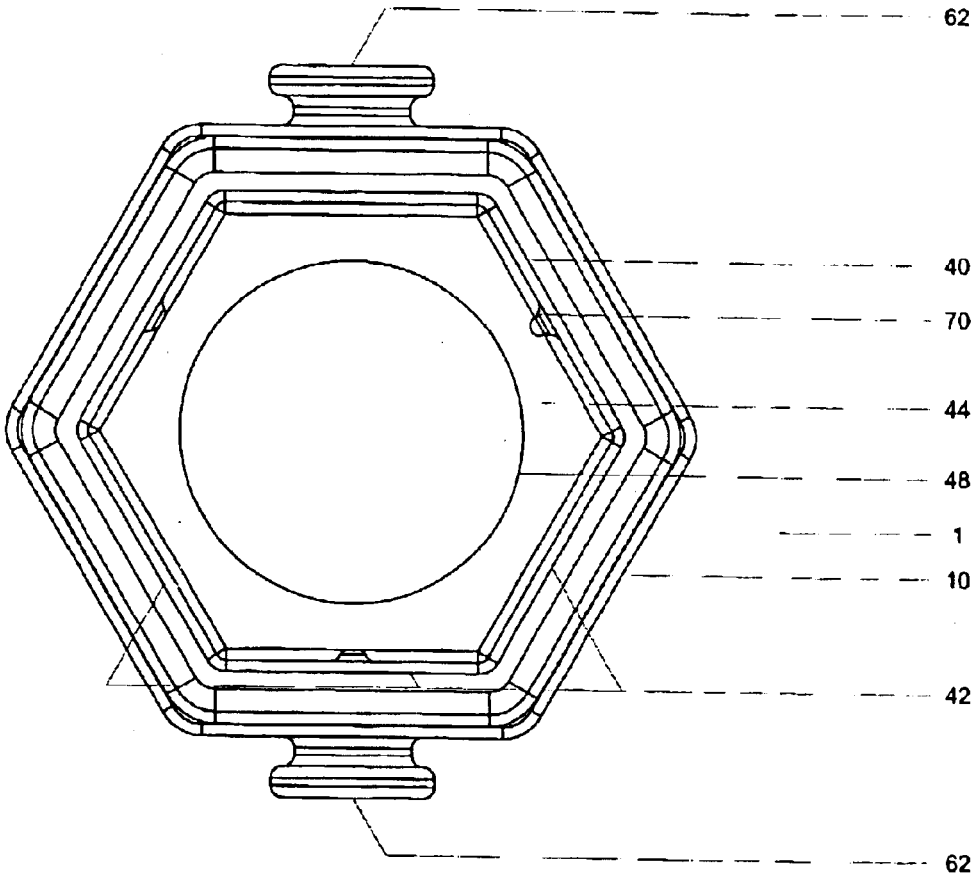
FIG. 2 is a top view of the device.
Figure 3:
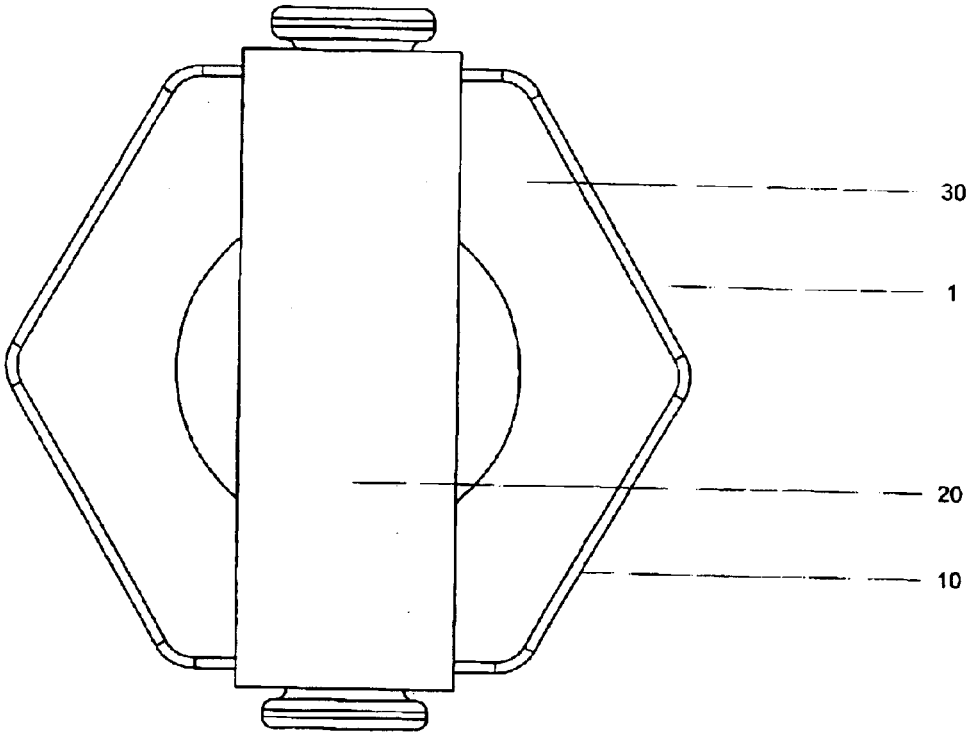
FIG. 3 is a bottom view of the device.
Figure 4:
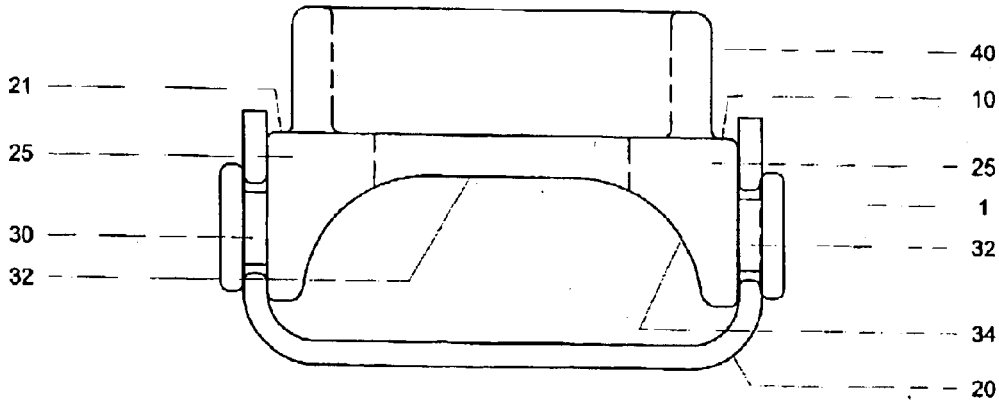
FIG. 4 is a back view of the device.
Figure 5:
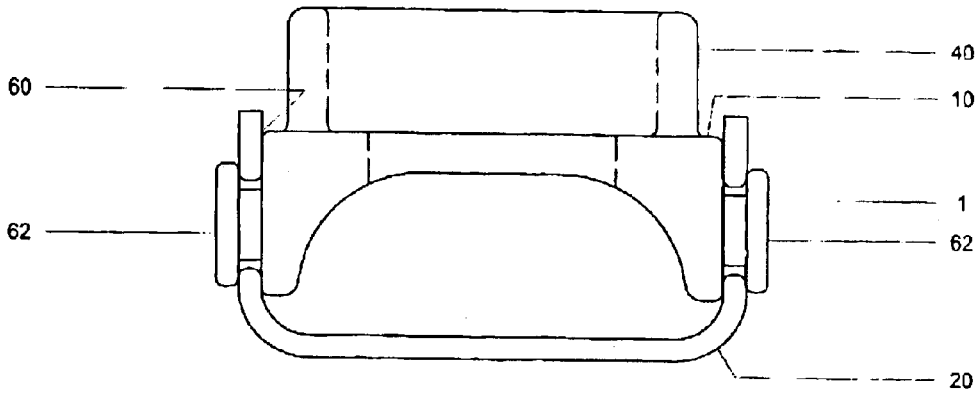
FIG. 5 is a front view of the device.
Figure 6:
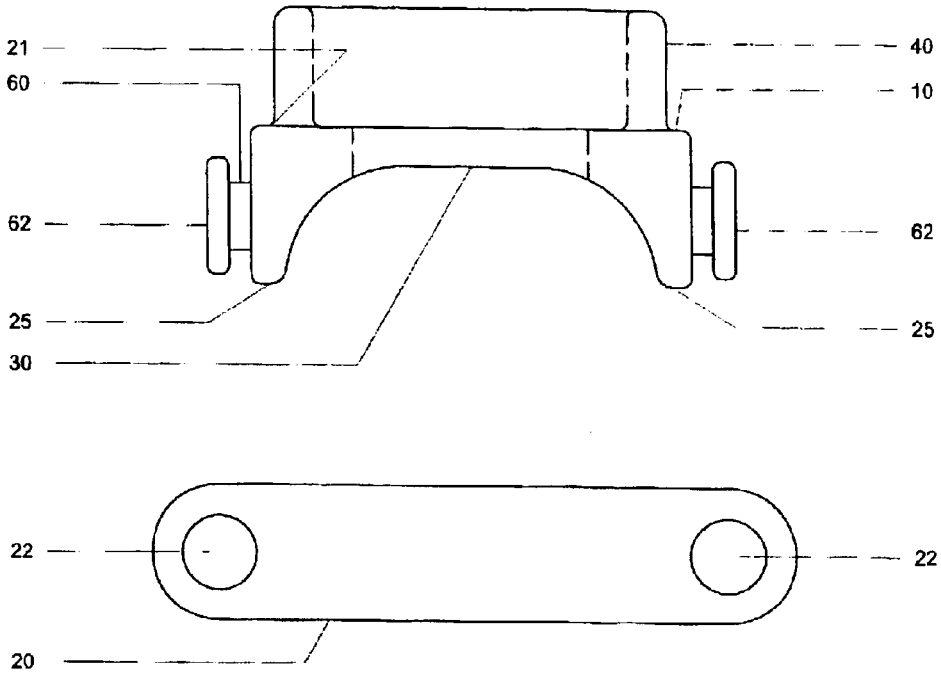
FIG. 6 shows the main components of the device.

The following description of a finger wrench is demonstrative in nature and is not intended to limit the scope of the invention or its application of uses.

FIGS. 1 through 6 display the finger wrench 1. The finger wrench 1 comprises a base 10 and a retainer band 20.

The base 10 has a top end 21, side 25 and a bottom end 30. The top end 21 has a flat surface. The bottom end 30 is arced to fix the contours of a person's finger, thumb or a shaft.

Figure 7:
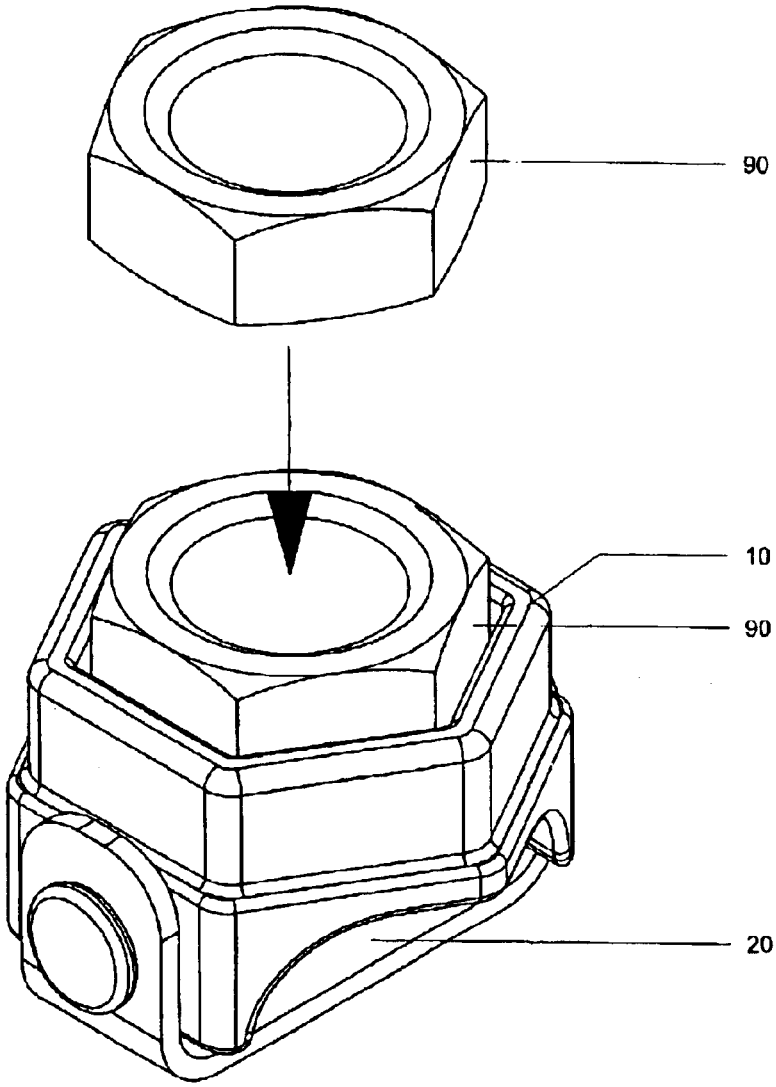
FIG. 7 shows a nut being held by the device.

The base 10 has a nut holder 40 on the top end 21. In the preferred embodiment, the nut holder 40 is comprised of six walls 42 of equal lengths. These lengths would match one of the standard nut sizes. These sizes include but are not limited to 4 mm, 4.5 mm, 5 mm, 6 mm, 7 mm, 8 mm, 9 mm, 10 mm, 11 mm, 12 mm, 13 mm, 14 mm, 15 mm, 3/16 inch, 7/32 inch, 1/4 inch, 9/32 inch, 5/16 inch, 11/32 inch, 3/8 inch, 7/16 inch, 1/2 inch and 9/16. The current invention can use other sizes including non-standard sizes as well. The height of the walls 42 in the preferred embodiment is 1/4 of an inch. The walls 42 extend from the base 10 with the top of the nut holder 40 being perpendicular to the walls 42 and being open forming the nut holder opening 44 so the nut 90 can be placed in the nut holder 40 as shown in FIG. 7. The base 10 has a nut holder floor 46 which is at the bottom of the nut holder 40 opposite the nut holder opening 44. The nut holder floor 46 is perpendicular to the walls 42 and is a flat surface. The nut holder floor 46 stops the nut 90 from going through the nut holder 40 allowing the nut holder 40 to hold the nut 90 in place. In the preferred embodiment, the nut holder floor 46 has a circular opening 48 through it and the base 10. This circular opening 48 is of a size that the nut 90 will not fall through but large enough so that a bolt shaft for the nut size of the wrench 1 can fit through it.

Figure 8:
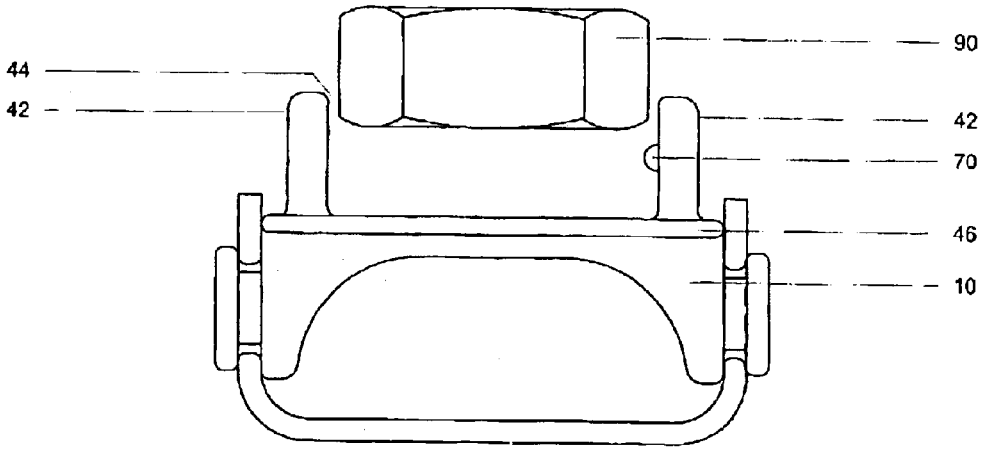
FIG. 8 shows the nub with a nut.
Figure 9:
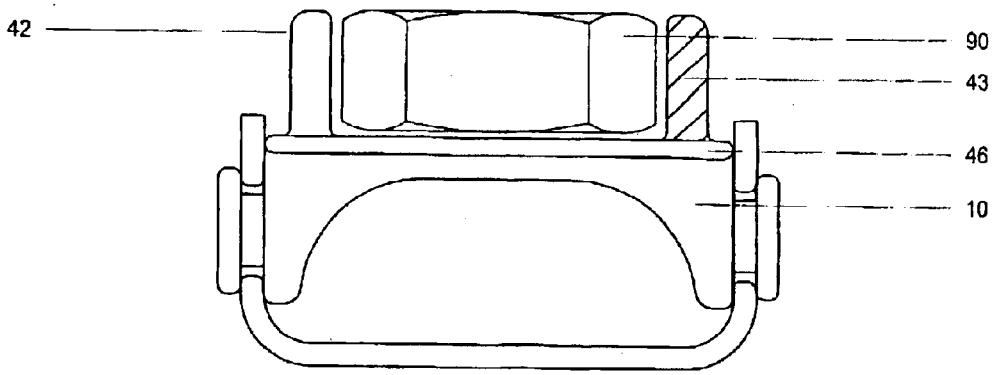
FIG. 9 shows the device being used with magnets.

The nut holder 40 will have a nut securing means 70 in the preferred embodiment. The nut securing means 70 is a means to secure the nut 90 so that the nut 90 will stay in the nut holder 40 even if the nut holder opening 44 is turned towards the ground. In the preferred embodiment a compression/tension means is used. A plastic or polyurethane nub 70 is added to one or more of the walls 42 of the nut holder 40. When the nut 90 is placed into the nut holder 40 the nub 70 will make contact with one of the sides of the nut 90 and will be compressed. This compression will hold the nut 90 in the nut holder 40 through the fraction between the compressed nub 70 and the side wall of the nut 90 as show in FIG. 8. Other forms of securing the nut 90 can be used, such as nubs where the wall 42 meet, springs from the walls 42 or as shown in FIG. 9 one or more of the walls 42 could be magnetized 43.

In the preferred embodiment, the wrench will have two latches 60 on opposite sides of the base 10. These sides are the one that match the contours of the bottom 30 to the latches 60 are on the long sides 32 of the contour 34. These latches 60 extend out of the base 10 perpendicular to the walls and parallel to the nut holder floor 46. The latches end in a button 62. The button 62 is used to secure the retainer band 20.

Figure 10:
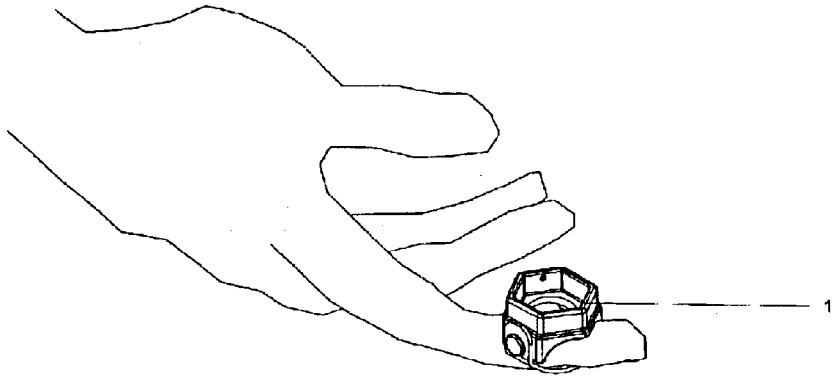
FIG. 10 shows the device on a finger.

The retainer band 20 is an elongated shape and has two band openings 22 at each of the elongated ends. The retainer band 20 in the preferred embodiment is made of an elastic material such as rubber or elastic. The two band openings 22 fit over the buttons 62 of the base 1 thereby forming a loop. A user's finger or a shaft fits into the loop. The elastic material will hold the wrench 1 securely against the finger or shaft as shown in FIG. 10. It can be used at the tip of a finger for better control and a better ability to feel for the proper location to place the nut. The device 1 can also be used on the thumb.

Preferably the base of the finger wrench is fabricated of quality stainless steel used in making fine tools. The finger wrench can also be made of a durable hard plastic. In operation, the nut 90 is placed within the finger wrench 1 and is held in place using the securing means 70. The finger wrench 1 with the nut 90 is placed where the nut 90 is needed to be screwed or tightened on to. The finger wrench 1 is used to hold the nut 90 in place while a bolt is turned. In another operation the finger wrench 1 is placed over a nut 90 while the connecting means or bolt and turned to tighten or loosen the nut 90 or bolt.

It is understood that the preceding description is given merely by way of illustration and not in limitation of the invention and that various modifications may be made thereto without departing from the spirit of the invention as claimed.

Although many features, functions, and advantages of the present invention have been described in this specification, together with details of the structure of specific embodiments thereof the description as a whole is illustrative only, and substitutions may be made in detail, especially in matters of shape, dimension and arrangement of elements within the principles of the invention to the full extent indicated by the broad, general meaning of the terms in which the claims are expressed.

Alternative Embodiment

The device 1, in an alternative embodiment, is made of a one solid piece where the base and the retainer band are molded or connected together much like a ring. This can be made by injection molding.

Figure 11:
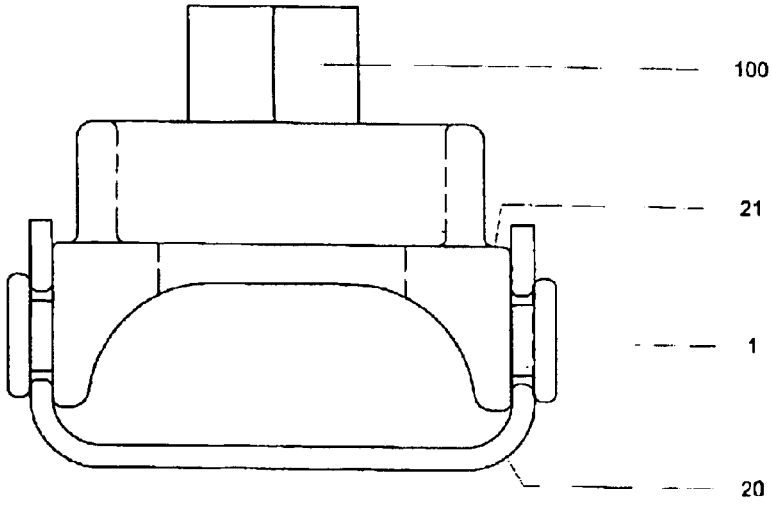
FIG. 11 shows the device with a socket holder.

In an addition embodiment, the finger wrench has a socket holder 100 instead of a nut holder as shown in FIG. 11. This socket holder would be an industry standard socket holder and would work with standard sockets of different sizes. The finger wrench can also be designed to work with an inverted torx wrench.

Advantages

The previously described version of the present invention has many advantages, including many elements missing in all prior art. It provides a wrench that can be used in difficult to reach and use areas.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed. Therefore, the point and scope of the appended claims should not be limited to the description of the preferred versions contained herein.

What is claimed is:

1. A finger wrench comprising;

a base having a top surface, a bottom surface and two sidewalls with each of said sidewalls having a button; said bottom surface of said base being contoured to fit the shape of a finger; a nut holder formed on said top surface of said base defined with a plurality of sidewalls; said nut holder having a nut securing means; and an elastic retainer band having an elongated shape defining two ends with each end including an opening;

wherein said elastic band is detachably connected to said base by said openings engaging said buttons.

2. The wrench as in claim 1, wherein said securing means is a nub on at least one of the sidewalls of said nut holder.

3. The wrench as in claim 1, wherein said securing means is a magnet.

4. The wrench as in claim 1, wherein said plurality of sidewalls comprises six equal sides that run perpendicular to said base.

* * * * *